US005967241A

United States Patent [19]

Cross et al.

[11] Patent Number: 5,967,241

[45] Date of Patent: Oct. 19, 1999

[54] ATV LIFT HANDLE

[75] Inventors: Gary Cross, Estherville; Glen E. Carlson, Milford, both of Iowa

[73] Assignee: Cycle Country Accessories Corp., Milford, Iowa

[21] Appl. No.: 08/917,661

[22] Filed: Aug. 25, 1997

[51] Int. Cl.[6] ..... E02F 3/76

[52] U.S. Cl. ..... 172/811; 172/776; 37/231; 37/266; 37/270; 37/466; 180/313

[58] Field of Search ..... 172/824, 825, 172/811, 815, 683, 776; 37/231, 266, 214, 219, 270, 271, 407, 403, 466; 180/313; 56/17.1, 17.2

[56] References Cited

U.S. PATENT DOCUMENTS

| | | | |
|---|---|---|---|
| 2,909,021 | 10/1959 | McLane | 56/17.1 X |
| 3,972,160 | 8/1976 | Boswell | 56/17.2 X |
| 4,551,967 | 11/1985 | Murcko | 56/17.1 X |
| 4,825,570 | 5/1989 | Schmid et al. | 37/231 |
| 4,890,400 | 1/1990 | Long | 172/815 X |
| 5,154,241 | 10/1992 | Comer et al. | 172/811 X |
| 5,615,745 | 4/1997 | Cross | 172/811 |
| 5,816,033 | 10/1998 | Busboom et al. | 56/17.1 X |

*Primary Examiner*—Victor Batson

*Attorney, Agent, or Firm*—Zarley,McKee,Thomte Voorhees & Sease; Dennis L. Thomte

[57] ABSTRACT

An ATV lift handle is provided for an all terrain vehicle having a vertically movable blade at the forward end thereof. The vertical movement of the blade is controlled by a lift handle positioned rearwardly thereof and which is pivotally mounted on a lift handle bracket. The lift handle bracket has a locking pin movably mounted thereon which protrudes outwardly and rearwardly therefrom when in its extended locked position. The locking pin is movable from its extended locked position to a retracted non-locking position against the resiliency of a spring operatively connected thereto. When it is desired to lock the blade in its upper non-working position, the lift handle is pivotally moved rearwardly of the protruding locking pin and is placed in engagement therewith to prevent the lift handle from moving forwardly. When it is desired to lower the blade, the lift handle is pivotally moved with respect to the lift handle bracket to disengage the lift handle from the locking pin and to cause the locking pin to move to its retracted non-locking position. When it is desired to raise the blade, the lift handle is pivotally moved rearwardly into engagement with the locking pin with the engagement therewith causing the locking pin to move to its retracted position so that the lift handle may be moved rearwardly without requirement that the lift handle also be pivotally moved outwardly with respect to the lift handle bracket.

11 Claims, 4 Drawing Sheets

ATV LIFT HANDLE

BACKGROUND OF THE INVENTION

1. Field of the Invention

This invention relates to an all terrain vehicle (ATV) and more particularly to a lift handle used in conjunction with an ATV having a vertically movable blade at the forward end thereof.

2. Description of the Related Art

All terrain vehicles (ATVs) have met with increased popularity during the last few years. The ATVs have been used for cultivating, plowing, disking, plowing snow, etc. In connection with the use of the ATV for plowing snow, dirt, etc., a vertically movable blade is mounted at the forward end of the ATV, such blade being operatively connected to a lift handle which is positioned at one side of the ATV so that the operator of the ATV may raise and lower the blade as required. In many applications, the blade at the forward end of the ATV has a bell crank apparatus connected thereto which includes a rearwardly extending lift rod which is connected to a lift handle so that the operator may pull the lift handle rearwardly to raise the blade and may move the lift handle forwardly to allow the blade to lower into engagement with the dirt, snow, etc. In many cases, the lift handle is pivotally mounted on a lift handle bracket which is secured to the ATV. The lift handle, in many cases, has a locking pin extending therefrom which engages the rearward end of the lift handle bracket to yieldably lock the lift handle in its rearward position so that the blade is maintained in its raised position. When the lift handle is moved between its rearward and forward positions or locked and unlocked positions, the locking pin rubs along the outer surface of the lift handle bracket and will eventually wear through the lift handle bracket.

In an effort to overcome the shortcomings of the prior art, the inventor herein previously provided an ATV lift handle rub block which is described in U.S. Pat. No. 5,615,745.

Although the ATV lift handle rub block of applicant's earlier patent did provide a significant advance in the art, it has been found that, in some situations, the lift rod, which extends between the bell crank apparatus and the lift handle, does not have sufficient clearance or room with respect to other structure on the ATV to permit the lift rod to be moved laterally when the lift handle is moved outwardly with respect to the lift handle bracket during the raising and lowering of the blade. The instant invention permits the lift handle to be moved between its raised and lowered positions with a minimum amount of outward movement of the lift handle being required.

SUMMARY OF THE INVENTION

The ATV lift handle of this invention is designed to be used with an all terrain vehicle having a selectively vertically movable blade at the forward end thereof. The blade has a lift arm linkage extending rearwardly therefrom which is connected to a lift handle pivotally mounted on the lift handle bracket. The lift handle bracket has an opening extending therethrough having a locking pin movably positioned therein. The locking pin is movable from an extended locking position, wherein its outer end is positioned outwardly of the outer surface of the lift handle bracket, to a retracted nonlocking position. A spring means normally urges the locking pin to its extended locking position. The lift handle is positioned forwardly of the locking pin when the lift handle is positioned in its forward position wherein the blade is in its operative position. The lift handle is positioned rearwardly of the locking pin and is in engagement therewith when the lift handle is in its rearward position with the blade being locked in its upper inoperative position. The locking pin protrudes angularly through the lift handle bracket so that engagement of the lift handle therewith as the lift handle is moved from its forward position to its rearward position will cause the locking pin to move from its extended locking position to its retracted non-locking position.

It is therefore a principal object of the invention to provide an improved ATV lift handle.

Still another object of the invention is to provide an ATV lift handle assembly which prevents the wear on the lift handle bracket which is experienced in some prior art devices.

Yet another object of the invention is to provide an ATV lift handle assembly which includes a retractable locking pin.

Still another object of the invention is to provide an ATV lift handle assembly wherein the lift handle may be moved between its lowered and raised positions with a minimum amount of outward or lateral movement, with respect to the lift handle bracket, being required.

These and other objects will be apparent to those skilled in the art.

BRIEF DESCRIPTION OF THE DRAWINGS

1

DESCRIPTION OF THE PREFERRED EMBODIMENT

Figure 1:
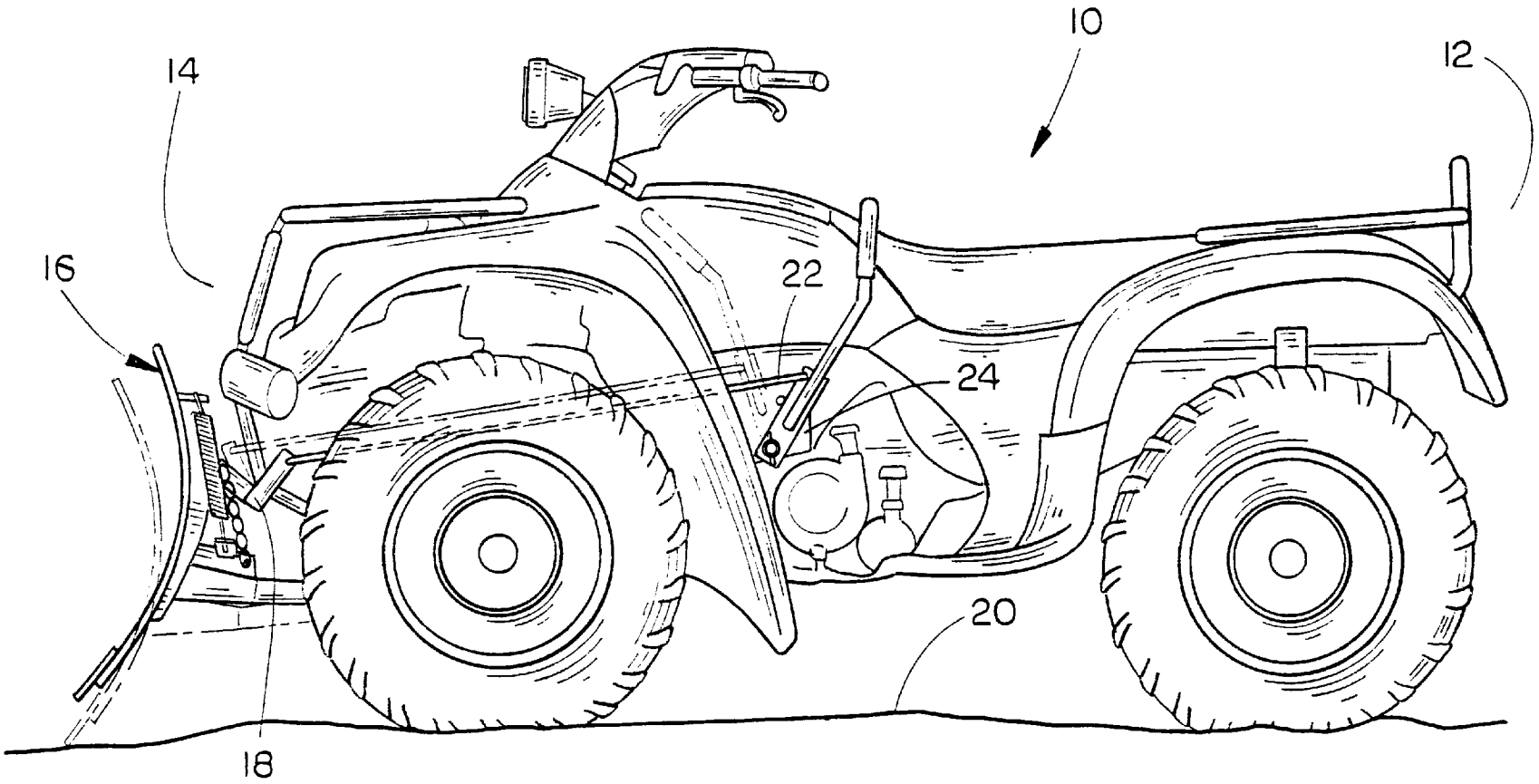
FIG. 1 is a side elevational view of an all terrain vehicle having the device of this invention mounted thereon.

In FIG. 1, the numeral 10 refers generally to a self-propelled vehicle such as an all terrain vehicle (ATV) having a rearward end 12 and a forward end 14. ATV 10 includes a conventional vertically movable blade assembly 16 at its forward end having a conventional bell crank 18 operatively secured thereto for raising and lowering the blade with respect to the ground 20. The numeral 22 refers to a lift arm which has its forward end pivotally connected to the bell crank device 18 and which extends rearwardly therefrom.

The numeral 24 refers to a lift handle bracket which is secured to one side of the ATV 10 by bolts or the like and which has a forward end 26, rearward end 28, upper end 30 and lower end 32. Lift handle bracket 24 also will be described as having an outer surface 34 and an inner surface 35. Bolt or stud 36 extends outwardly from the outer surface 34 of lift handle bracket 24 and is adapted to receive a spring 38 thereon as well as a wing nut 40.

The numeral 42 refers to a lift handle having an upper end 44 and a lower end 46. Plate 48 is welded to the lower end of lift handle 42 and forms a part of the lift handle 42. Plate 48 has an opening 50 formed therein adjacent its upper end which is adapted to receive the rearward end of lift arm 22. Plate 48 also has an opening 52 formed therein adjacent its lower end which is adapted to receive the stud 36. Spring 38 is positioned outwardly of plate 48 and is retained thereon by wing nut 40 to permit plate 48 and lift handle 42 to pivot with respect to stud 36 and also to permit the upper end of lift handle 42 to be selectively moved outwardly with respect to the lift handle bracket 24 as desired.

Figure 6:
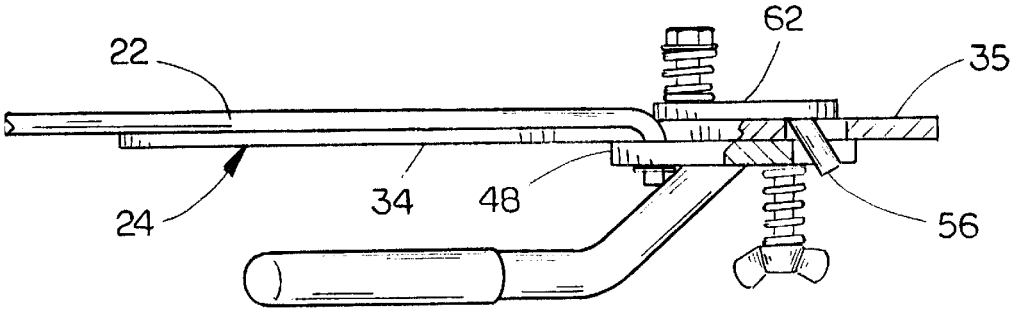
FIG. 6 is a view similar to FIG. 5 except that the lift handle has been moved from its rear position to its forward position.

Lift handle bracket 34 has an opening 54 formed therein which has a locking pin 56 movably mounted therein. For purposes of description, locking pin 56 will be described as having an outer end 58 and an inner end 60. The inner end 60 of locking pin 56 is welded, or otherwise secured, to locking pin support bracket 62 which is positioned inwardly of lift handle bracket 56. Locking pin support bracket 62 has an opening 64 formed in its lower end which is adapted to receive a bolt 66 extending from lift handle bracket 24. Spring 68 is mounted on bolt 66 inwardly of support bracket 62 and is retained thereon by means of nut 70 to enable the upper end of locking pin support bracket 62 to move inwardly and outwardly with respect to lift handle bracket 24. Spring 68 normally urges the upper end of bracket 62 towards lift handle bracket 24 so that locking pin 56 is urged to its extended locking position, as illustrated in FIG. 6. As seen in the drawings, locking pin 56 extends outwardly and rearwardly with respect to the lift handle bracket for a purpose which will be described hereinafter.

Figure 2:
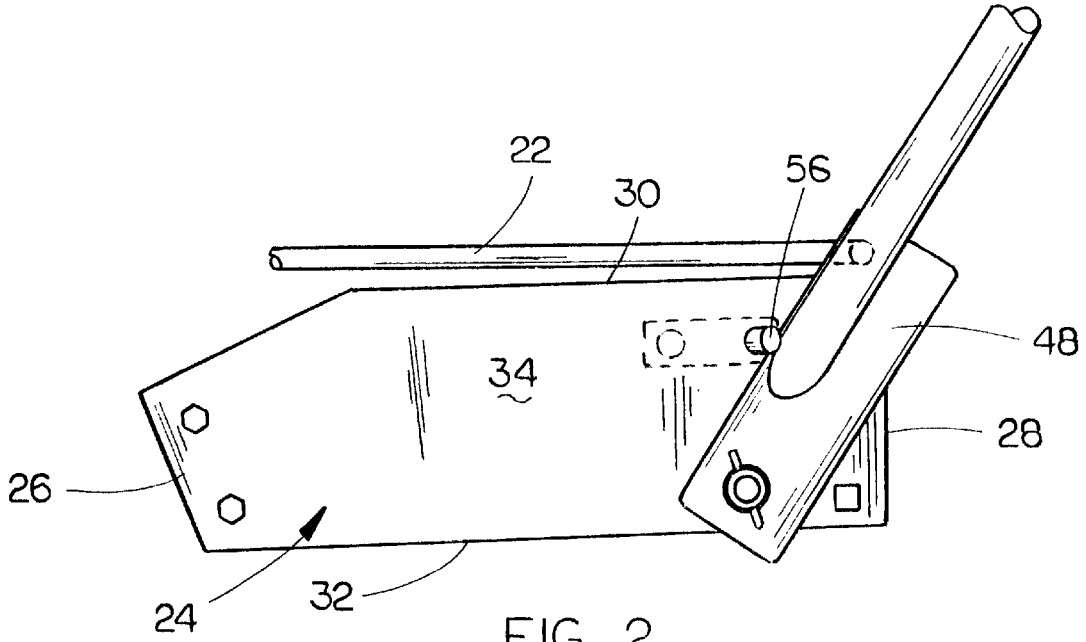
FIG. 2 is a side elevational view of the device of this invention.
Figure 3:
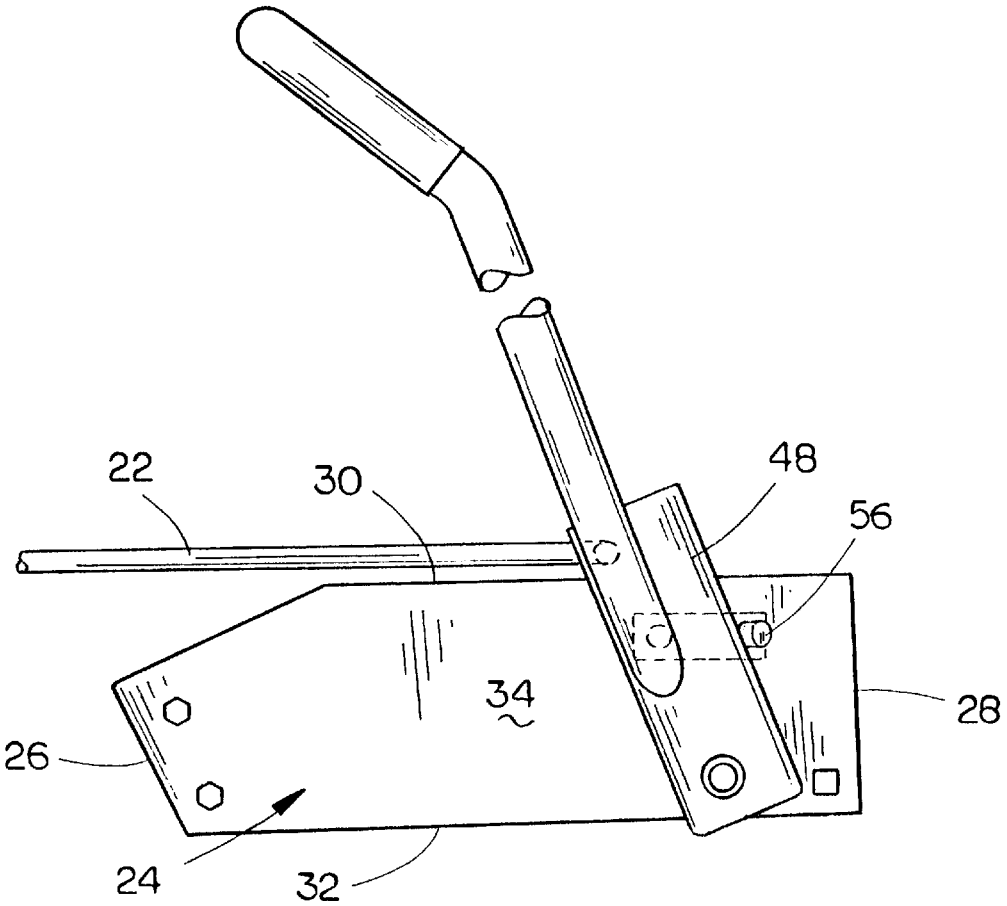
FIG. 3 is a view similar to FIG. 2 except that the lift handle has been moved from its rear locked position to its forward position.
Figure 4:
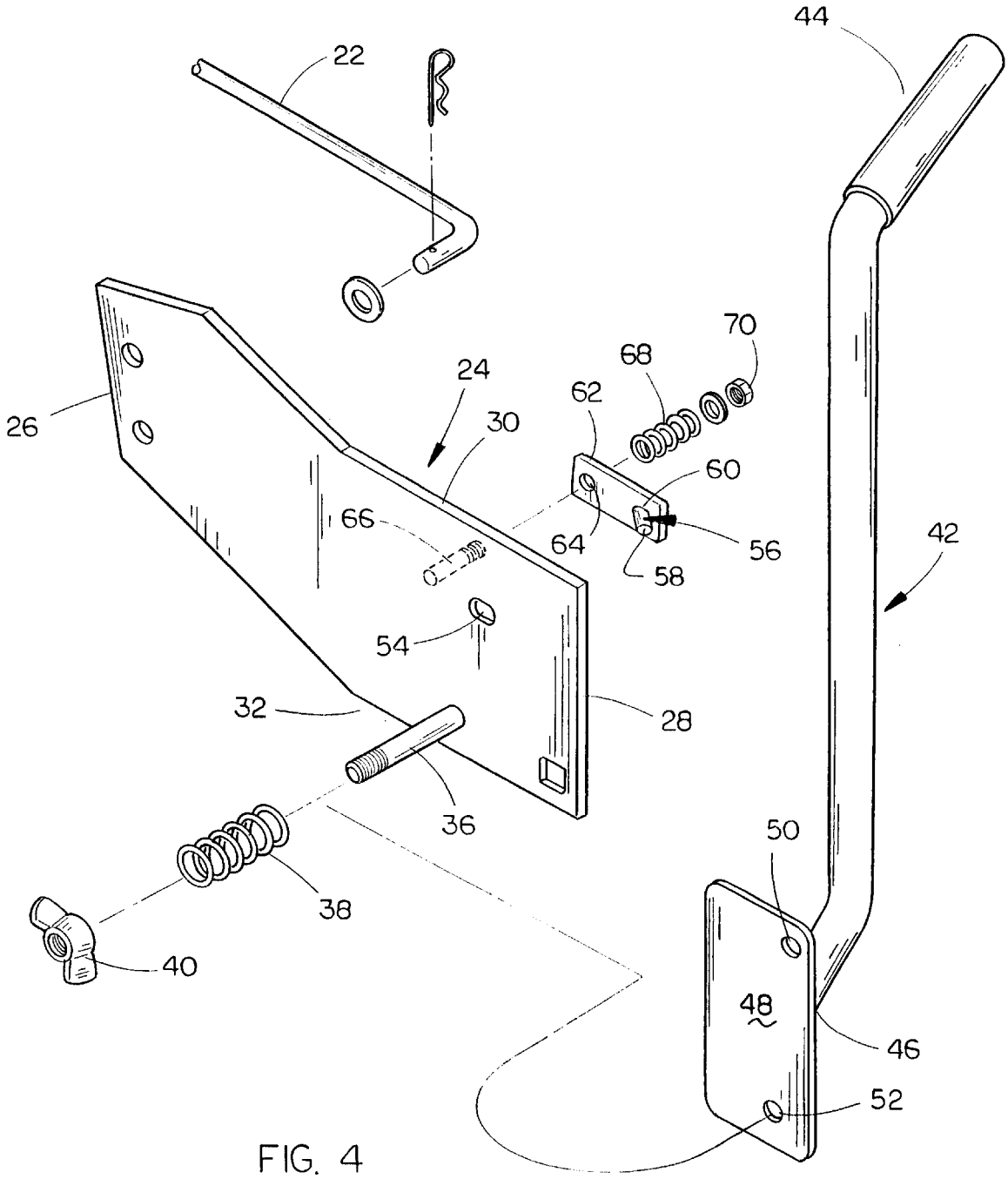
FIG. 4 is an exploded perspective view of the device of this invention.
Figure 5:
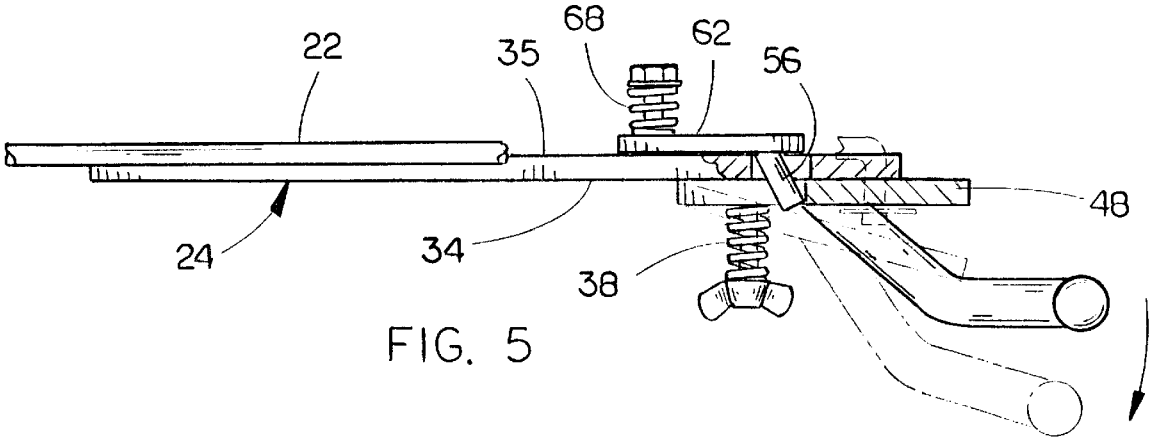
FIG. 5 is a top elevational view of the invention with portions thereof cut away to more fully illustrate the invention, with the broken lines illustrating the manner in which the lift handle is moved outwardly with respect to the lift handle bracket.
Figure 7:
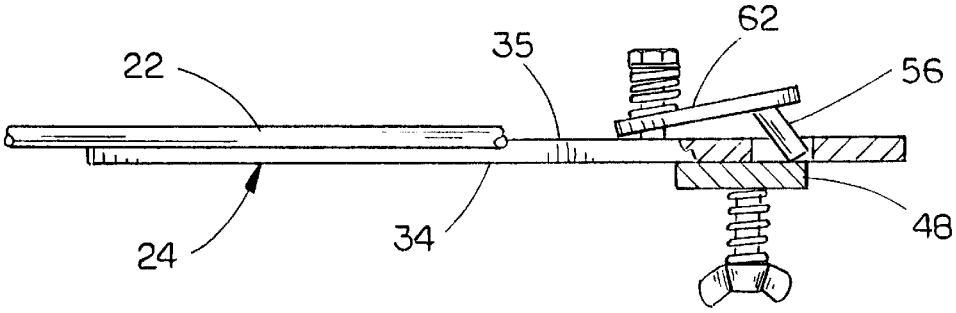
FIG. 7 is a view similar to FIG. 6 except that the lift handle has been moved rearwardly from the position of FIG. 6.

The lift handle 42 is designed to be positioned in that position shown in FIG. 2 wherein the forward end of plate 48 of lift handle 42 is positioned rearwardly of the locking pin 56 which maintains the lift handle 42 in its rearward position and which maintains the blade 16 in its upper position. When it is desired to lower the blade 16 from its upper position to its lower position, the upper end of the lift handle 42 is moved outwardly with respect to the lift handle bracket 24 so that plate 48 may be moved outwardly with respect to the locking pin 56, as illustrated in FIG. 5. As soon as the plate 48 has been moved sufficiently outwardly and forwardly so as to be positioned outwardly of the outer end 58 of locking pin 56, the operator permits the upper end of the lift handle 42 to move inwardly towards the lift handle bracket 24, which is caused by the spring 38, which causes the locking pin 56 to move to its retracted non-locking position seen in FIG. 7. Thus, with the locking pin 56 retracted, the lift handle 42 may be moved forwardly to allow the blade 16 to be lowered to its working position. Inasmuch as the lift handle 42 is closely positioned adjacent to the lift handle bracket 24 once the locking pin 56 has been retracted, additional lateral clearance for the lift arm 22 is not required. Further, inasmuch as the locking pin 56 is in its retracted position as the lift handle 42 is moved to its forward position, the locking pin 56 will be in very little rubbing engagement with the inner surface of plate 48, thereby eliminating or reducing the wear thereon.

When it is desired to raise the blade 16 from its lowered working position, the lift handle 42 is moved rearwardly from its forward position of FIG. 6 until it engages the locking pin 56, with continued rearward movement of the lift handle 42 causing the plate 48 of lift handle 42 to push or force the locking pin 56 inwardly from its extended position to its retracted position without the necessity of pivotally moving the lift handle 42 outwardly with respect to the lift handle bracket 24. The lift handle 42 is continued to be moved rearwardly until the forward end of plate 48 of lift handle 42 is positioned rearwardly of the locking pin 56 at which time the spring 68 will pivotally move the support bracket 62 towards lift handle bracket 24 to cause locking pin 56 to again move to its extended locking position. The operator then pivotally moves the lift handle 42 forwardly until the forward end of plate 48 engages locking pin 56 which maintains the lift handle 42 in its locked position.

Thus it can be seen that a novel ATV lift handle has been provided which prevents wear on the lift handle bracket and which eliminates the need for the rub blocks described in U.S. Pat. No. 5,615,745. The ATV lift handle of this invention is especially designed for those situations wherein there is very little space for the lift arm to move laterally when the lift handle 42 is moved between its lowered and raised positions.

Thus it can be seen that the above-described invention accomplishes at least all of its stated objectives.

We claim:

1. In combination:

a self-propelled vehicle having a forward end, a rearward end, and opposite sides;

a blade selectively vertically movably mounted at the forward end of said vehicle and being movable between raised and lowered positions;

a lift handle bracket secured to said vehicle at one side thereof rearwardly of said blade;

said lift handle bracket having inner and outer surfaces, a rearward end, and a forward end;

an upstanding lift handle, having upper and lower ends, positioned adjacent the outer surface of said lift handle bracket and being pivotally secured thereto;

said lift handle being pivotally movable, with respect to said lift handle bracket, between a rear position and a forward position;

pivot means connecting said lift handle to said lift handle bracket;

a linkage operatively connecting said lift handle to said blade whereby said blade is positioned in its said raised position when said lift handle is positioned in its said rear position and whereby said blade is positioned in its said lowered position when said lift handle is positioned in its said forward position;

said lift handle bracket having an opening extending therethrough forwardly of the rearward end thereof;

a locking pin movably positioned in said opening in said lift handle bracket and having inner and outer ends;

said locking pin being movable from an extended locking position, wherein its said outer end is positioned outwardly of said outer surface of said lift handle bracket, to a retracted non-locking position;

means normally yieldably urging said locking pin to its said extended locking position;

said locking pin being positioned forwardly of said forward end of said lift handle, and being in engagement therewith, when said lift handle is in its said rear position to yieldably prevent said lift handle from moving to its said forward position;

said lift handle being positioned forwardly of said locking pin when in its said forward position;

said locking pin protruding angularly through said lift handle bracket whereby engagement of said lift handle therewith as said lift handle is moved from its said forward position to its said rearward position will cause said locking pin to move from its said extended locking position to its said retracted non-locking position.

2. The combination of claim 1 wherein said means normally urging said locking pin to its said extended locking position comprises a spring.

3. The combination of claim 1 wherein a locking pin support plate is positioned inwardly of said inner surface of said lift handle bracket and wherein said locking pin is mounted on said locking pin support plate.

4. The combination of claim 3 wherein said locking pin support plate is movably mounted on said lift handle bracket and wherein said means normally urging said locking pin to its said extended locking position comprises a spring which urges said locking pin support plate towards said lift handle bracket.

5. The combination of claim 1 wherein said locking pin extends outwardly and rearwardly with respect to said lift handle bracket when in its said extended locking position.

6. A lift handle bracket assembly for use with a self-propelled vehicle, said vehicle having a forward end, a rearward end, and opposite sides; a blade selectively vertically movably mounted at the forward end of said vehicle and being movable between raised and lowered positions; said vehicle including a linkage operatively connected to said blade for raising and lowering said blade with respect to said vehicle, comprising:

a lift handle bracket capable of being secured to said vehicle at one side thereof rearwardly of said blade;

said lift handle bracket having inner and outer surfaces, a rearward end, and a forward end;

an upstanding lift handle, having upper and lower ends, positioned adjacent the outer surface of said lift handle bracket and being pivotally secured thereto;

said lift handle being pivotally movable, with respect to said lift handle bracket, between a rear position and a forward position;

pivot means connecting said lift handle to said lift handle bracket;

a linkage operatively connecting said lift handle to said blade whereby said blade is positioned in its said raised position when said lift handle is positioned in its said rear position and whereby said blade is positioned in its said lowered position when said lift handle is positioned in its said forward position;

said lift handle bracket having an opening extending therethrough forwardly of the rearward end thereof;

a locking pin movably positioned in said opening in said lift handle bracket and having inner and outer ends;

said locking pin being movable from an extended locking position, wherein its said outer end is positioned outwardly of said outer surface of said lift handle bracket, to a retracted non-locking position;

means normally yieldably urging said locking pin to its said extended locking position;

said locking pin being positioned forwardly of said lift handle, and being in engagement therewith, when said lift handle is in its said rear position to yieldably prevent said lift handle from moving to its said forward position;

said lift handle being positioned forwardly of said locking pin when in its said forward position;

said locking pin protruding angularly through said lift handle bracket whereby engagement of said lift handle therewith as said lift handle is moved from its said forward position to its said rearward position will cause said locking pin to move from its said extended locking position to its said retracted non-locking position.

7. The assembly of claim 6 wherein said means normally urging said locking pin to its said extended locking position comprises a spring.

8. The assembly of claim 6 wherein a locking pin support plate is positioned inwardly of said inner surface of said lift handle bracket and wherein said locking pin is mounted on said locking pin support plate.

9. The assembly of claim 8 wherein said locking pin support plate is movably mounted on said lift handle bracket and wherein said means normally urging said locking pin to its said extended locking position comprises a spring which urges said locking pin support plate towards said lift handle bracket.

10. The assembly of claim 6 wherein said locking pin extends outwardly and rearwardly with respect to said lift handle bracket when in its said extended locking position.

11. In combination:

a self-propelled vehicle having a forward end, a rearward end, and opposite sides;

a blade selectively vertically movably mounted at the forward end of said vehicle and being movable between raised and lowered positions;

a lift handle bracket secured to said vehicle at one side thereof rearwardly of said blade;

said lift handle bracket having inner and outer surfaces, a rearward end, and a forward end;

an upstanding lift handle, having upper and lower ends, positioned adjacent the outer surface of said lift handle bracket and being pivotally secured thereto;

said lift handle being pivotally movable, with respect to said lift handle bracket, between a rear position and a forward position;

pivot means connecting said lift handle to said lift handle bracket;

said pivot means including spring means for permitting said lift handle to be moved laterally with respect to said lift handle bracket;

a linkage operatively connecting said lift handle to said blade whereby said blade is positioned in its said raised position when said lift handle is positioned in its said rear position and whereby said blade is positioned in its said lowered position when said lift handle is positioned in its said forward position;

projection means extending from said lift handle bracket towards said lift handle;

said projection means being positioned forwardly of said forward end of said lift handle, and being in engagement therewith, when said lift handle is in its said rear position to yieldably prevent said lift handle from moving to its said forward position;

said lift handle being positioned forwardly of said projection means when in its said forward position.

* * * * *